US007334977B2

(12) United States Patent
Bauer et al.

(10) Patent No.: US 7,334,977 B2
(45) Date of Patent: Feb. 26, 2008

(54) METHOD FOR THE PRODUCTION OF A RIM FOR A CAN LID

(75) Inventors: Sven Bauer, Steisslingen (DE); Bernd Baumann, Neuwied (DE); Josef Kesselem, Andernach (DE)

(73) Assignee: Alcan Technology & Management Ltd., Neuhausen am Rheinfall (CH)

( * ) Notice: Subject to any disclaimer, the term of this patent is extended or adjusted under 35 U.S.C. 154(b) by 0 days.

(21) Appl. No.: 10/542,418

(22) PCT Filed: Jan. 12, 2004

(86) PCT No.: PCT/EP2004/000128

§ 371 (c)(1),
(2), (4) Date: Jul. 15, 2005

(87) PCT Pub. No.: WO2004/062830

PCT Pub. Date: Jul. 29, 2004

(65) Prior Publication Data

US 2006/0062654 A1 Mar. 23, 2006

(30) Foreign Application Priority Data

Jan. 16, 2003 (EP) ..... 03405014

(51) Int. Cl.
*B21D 51/46* (2006.01)

(52) U.S. Cl. ..... 413/8; 413/12; 413/20; 29/527.4

(58) Field of Classification Search ..... 413/1, 413/7, 8, 12, 14, 16, 18, 20, 61; 72/379.4; 29/527.4

See application file for complete search history.

(56) References Cited

U.S. PATENT DOCUMENTS 2,997,904 A * 8/1961 Gotsch et al. ..... 83/37
3,523,513 A * 8/1970 Maier et al. ..... 413/69
4,363,582 A * 12/1982 Bloeck et al. ..... 413/12

(Continued)

FOREIGN PATENT DOCUMENTS

| | | |
|---|---|---|
| DE | 4332306 | 3/1995 |
| DE | 19625174 | 1/1998 |
| EP | 1153840 | 11/2001 |

OTHER PUBLICATIONS

Translation copy of DE 4332306.*

*Primary Examiner*—Jimmy T. Nguyen
(74) *Attorney, Agent, or Firm*—Fisher, Christen & Sabol

(57) ABSTRACT

In a process for production of a lid ring (30) which can be connected to the can body, which borders a discharge opening (38) and has a heat-sealable coating (40) on which to form a can lid (50) a closing membrane (44) can be heat-sealed covering the discharge opening (38), a metal strip (12) with parallel side edges (14, 16) is formed into a tube (20) and the side edges (14, 16) are welded or glued parallel to the tube longitudinal axis (x). The tube (20) produced in this way is divided into tube sections (24) of equal length with cut edges (26, 28) lying in parallel planes. The tube sections (24) are formed into lid rings (30) where a first cut edge (26) is formed into an outer rim (32) for connection to a can body and the second cut edge (28) is curled away from the side intended for the heat-sealable coating (40). The heat-sealable coating (40) is applied to the finished molded lid ring.

18 Claims, 1 Drawing Sheet

U.S. PATENT DOCUMENTS 4,508,481 A * 4/1985 Ishibashi et al. ..... 413/1
6,531,197 B2 * 3/2003 Neteler ..... 428/34.7
6,554,556 B2 * 4/2003 Erfgen et al. ..... 413/1
2001/0041115 A1 11/2001 Erfgen et al.

* cited by examiner

METHOD FOR THE PRODUCTION OF A RIM FOR A CAN LID

This is a 371 national stage application of International (PCT) Patent Application No. PCT/EP2004/00128, filed on Jan. 12, 2004, that has benefit of the priority of European Patent Application No. 03405014.6, filed on Jan. 16, 2003.

FIELD OF THE INVENTION

The invention concerns a process for production of a lid ring which can be connected to a can body, which borders a discharge opening and has a heat-sealable coating, on which to form a can lid a closing membrane can be heat-sealed covering the discharge opening, in which process a sheet metal strip with parallel side edges is formed into a tube and the side edges are welded or glued parallel to the tube longitudinal axis, the tube produced in this way is divided into tube sections of equal length with cut edges lying in parallel planes, and the tube sections are formed into lid rings, where a first cut edge is formed into an outer rim for connection with a can body and the second cut edge is curled.

BACKGROUND OF THE INVENTION

In known can lids with a lid ring and a closing membrane arranged thereon, the discharge opening extends up to the vicinity of the outer rim so that after removing the closing membrane, usually formed as a tear film, only a narrow ring surface remains radially adjacent on the inside to the outer rim. After removing (peeling) the membrane, as in a fully tear-off lid, a relatively large container opening results through which the filling is easily accessible. A further advantage of this lid system is that the filling can be sterilized.

In a process known from EP-A-1 153 840 for production of a lid ring for a can lid with closing membrane, first a flat sheet metal part with a heat-sealable coating on one side is formed into a cylindrical tube, the coating being on the inside. The axial edges of the tube are pressed and welded together, which can be achieved by means of a laser beam and leads to the formation of a butt weld seam. The tube is then divided into tube sections or cylindrical rings of equal length. Each cylindrical ring is formed into a lid ring with an outer rim for attachment to a can body and into an annular support surface for subsequent fixing of the closing membrane. Here, the edge bordering the later discharge opening is curled against the side with the heat-sealable coating.

The process described above for production of a lid ring starting from a cylindrical ring has the advantage of a considerable reduction in the amount of waste in comparison with the conventional method of lid ring production in which first a metal disc is molded and then the discharge opening punched out to form the lid ring.

In the process described in EP-A-1 153 840, it must be ensured that, on forming the butt weld seam, the adjacent heat-sealable coating is not damaged. For this, during the welding process a cooling plate is pressed against the inside of the tube along the axial edges. Despite these measures damage to the heat seal layer can never be completely excluded. As the heat seal layer also serves as corrosion protection, corrosion can occur later at damaged points on the weld seam.

SUMMARY OF THE INVENTION

The invention is based on the object of refining a process of the type cited initially so that optimum corrosion protection can be achieved.

To achieve the object according to the invention, the second cut edge is curled away from the side intended for the heat-sealable coating, and the heat-sealable coating is applied to the finished molded lid ring.

The subsequent coating of the lid ring according to the invention eliminates the corrosion problem which occurs in the process according to the prior art.

Suitable metals for performance of the process according to the invention are all metals known for the production of cans or lid rings such as aluminium, steel or tin plate.

Preferably, the parallel side edges of the metal strip are pressed together into a butt joint and welded by means of a laser beam to form a tube.

The heat-sealable coating can be sprayed onto the lid ring dissolved in a solvent in the known manner, or be applied to the lid ring by powder coating in powder form e.g. as a polypropylene powder.

In a preferred embodiment of the process according to the invention, the lid ring is coated with a heat-resistant lacquer on its side facing away from the heat-sealable coating. Suitably, the heat-resistant lacquer is sprayed onto the lid ring.

The tubes can be made of metal strip sections in the form of precut formats and independently of this divided into the individual tube sections.

The process according to the invention is particularly suitable for continuous production of lid rings. In a continuous production process the metal strip is present in the form of rolled goods as a coil and is formed into a tube continuously by rolling. The tube sections are continuously separated from the tube at a cycle rate corresponding to the speed of the tube length produced per time unit.

BRIEF DESCRIPTION OF THE DRAWINGS

Further advantages, features and details of the invention arise from the description below of preferred embodiment examples and the drawing; this shows diagrammatically:

In the drawings:

FIG. 6 is the lid ring of FIG. 5 with the closing membrane sealed on.

DETAILED DESCRIPTION OF THE INVENTION

Figure 1:
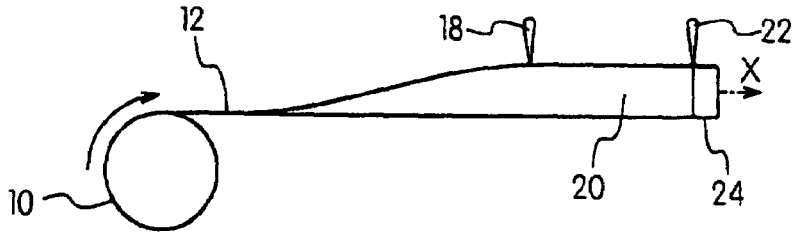
FIG. 1 is a side view of a plant for continuous production of tube sections.
Figure 2:
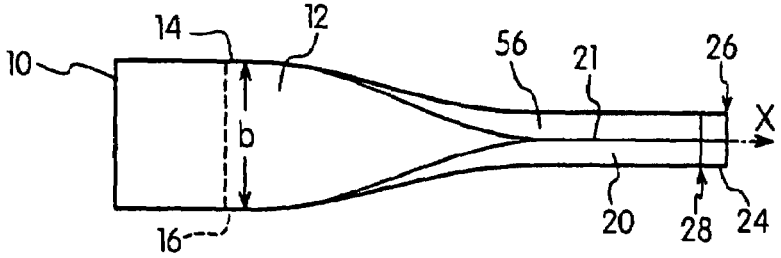
FIG. 2 is a top view onto the plant in FIG. 1.

In a process shown in FIGS. 1 and 2, a strip wound into a coil 10 as rolled product in the form of a metal strip 12 with parallel side edges 14, 16 is unwound from the coil 10 and formed continuously into a tube by rolling in the conveyor direction x. Here, the parallel side edges 14, 16 of the metal strip 12 are pressed together into a butt joint and welded together by means of a laser beam 18 into a tube 20 forming a longitudinal weld seam 21. The tube 20 is then divided in a cutting or separating device 22 into tube sections of equal length in the form of cylindrical rings 24 of equal height h.

Figure 3:
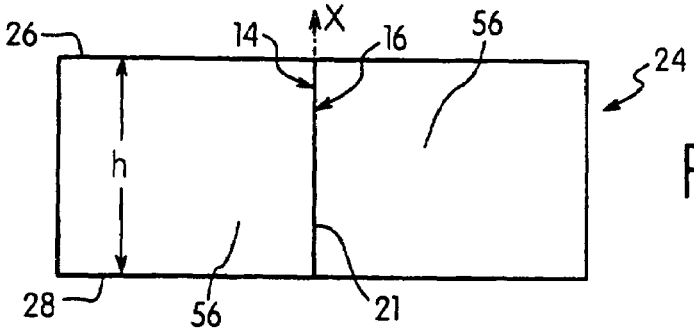
FIG. 3 is an oblique view onto a tube section.
Figure 4:
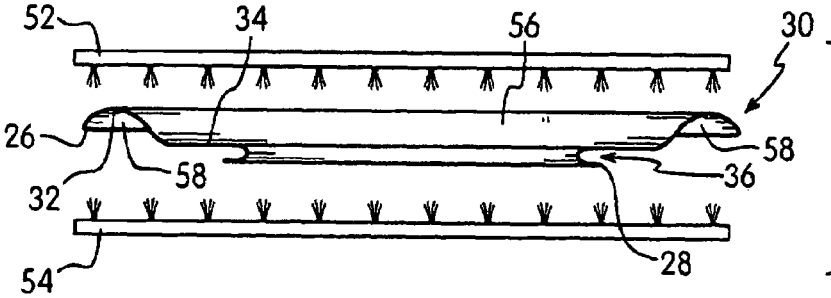
FIG. 4 is a partly cut-away side view of a lid ring produced from the tube section in FIG. 3.
Figure 5:
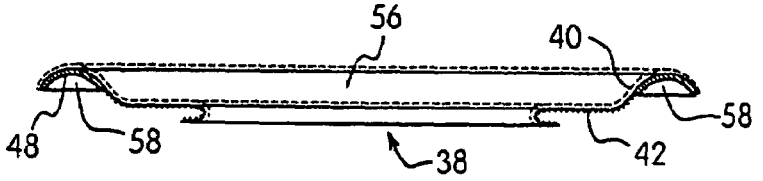
FIG. 5 is the lid ring in FIG. 4 coated on both sides.

A cylindrical ring 24 shown in FIG. 3, the periphery of which substantially corresponds to the width b of the metal strip 12, is formed in the known manner into the lid ring 30 shown in FIG. 4 by several successive forming operations.

The lid ring 30 has a conventional outer rim 32, the free end of which corresponds to a first cut edge 26 of the cylindrical ring 24. The outer rim 32 transforms into a horizontal ring surface 34. The inner edge 36 of the ring surface 34 bordering the discharge opening 38 is curled to eliminate risk of injury and to increase the rigidity of the lid ring 30 with the edge angled radially outwards, which corresponds to the second cut edge 28 of the cylindrical ring 24. The inner edge 36 of the horizontal ring surface 34 is curled such that the second cut edge 28 of the cylindrical ring 24 comes to lie on the side later facing the inside of the can.

By way of spray devices 52, 54 the lid ring 30, on what will become its outside 56, is fitted with the heat-sealable coating 40 and on the side which will later face the can interior, with a heat-resistant lacquer coating 42. On the inside 58 of the outer rim 32 is also applied a sealant 48. The sprayed layers 40, 42 and sealant 48 are normally dried in an oven.

Figure 6:
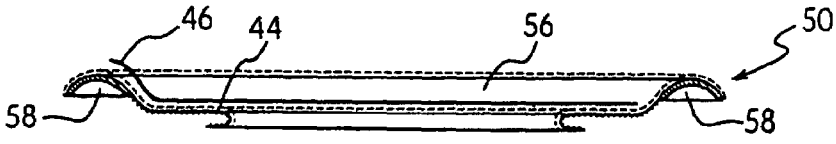

FIG. 6 shows the lid ring 30 with a closing membrane 44. The closing membrane 44 which also has a heat-sealable coating e.g. polypropylene, is sealed against the heat-sealable coating 40 of the lid ring 30 and thus forms a can lid which is easy to open. The closing membrane 44 can be fitted with a tear tab 46. In this case the seal between the closing membrane 44 and the ring surface 34 is set such that the closing membrane can be removed from the ring surface or the seal edge by peeling. In an alternative embodiment the closing membrane 34 is connected inseparably with the lid ring 30. In this case the membrane is pierced for opening and removed from the lid ring 30 along the inner edge of the ring surface 34.

The lid ring 30 fitted with the closing membrane 44 is flanged onto a can body as a can lid 50 after the can has been filled with a product. The filling can however also be placed in a can body which has been previously fitted with a lid ring 30. In this case as the final step the closing membrane 44 is sealed onto the lid ring 30.

The invention claimed is:

1. A process for production of a lid ring (30), that can be connected to a can body, and that borders a discharge opening (38) and has a heat-sealable coating (40), on which to form a can lid (50) a closing membrane (44) can be heat-sealed covering the discharge opening (38), in which process a metal strip (12) with parallel side edges (14, 16) is formed into a tube (20) and the side edges (14, 16) are welded or glued parallel to the tube longitudinal axis (x), the tube (20) is divided into tube sections (24) of equal length with cut edges (26, 28) lying in parallel planes, and the tube sections (24) are molded into lid rings (30), where a first cut edge (26) is formed into an outer rim (32) for connection with the can body and a second cut edge (28) is curled, the second cut edge (28) is curled away from a side (56) of the lid ring (30) intended for the heat-sealable coating (40), the heat-sealable coating (40) is applied to the side (56) of the finished molded lid ring (30) intended to be outside of the finished molded lid ring (30), and a heat-sealable lacquer coating (42) is applied to side (58) of the finished molded lid ring (30) intended to face interior of the can body.

2. The process according to claim 1, wherein the metal strip (12) comprises aluminum, steel or tin plate.

3. The process according to claim 1, wherein the parallel side edges (14, 16) of the metal strip (12) are pressed together in a butt joint and welded into the tube (20) by means of laser beam (18).

4. The process according to claim 1, wherein the heat-resistant lacquer (42) is sprayed onto the lid ring (30).

5. The process according to claim 1, wherein the metal strip (12) is formed into the tube (20) as a precut format and welded.

6. The process according to claim 1, wherein the metal strip (12) is present as a coil (10) and is continuously formed into the tube (20).

7. The process according to claim 6, wherein the tube sections (24) are continuously separated from the tube (20) at a cycle rate corresponding to the speed of the tube length produced per time unit.

8. The process according to claim 2, wherein the parallel side edges (14,16) of the metal strip (12) are pressed together in a butt joint and welded into the tube (20) by means of laser beam (18).

9. The process according to claim 4, wherein the metal strip (12) is formed into the tube (20) as a precut format and welded.

10. The process according to claim 4, wherein the metal strip (12) is present as a coil (10) and is continuously formed into the tube (20).

11. A process for production of a lid ring (30) that can be connected to a can body, and that borders a discharge opening (38) and has a heat-sealable coating (40), on which to form a can lid (50) a closing membrane (44) can be heat-sealed covering the discharge opening (38), in which process a metal strip (12) with parallel side edges (14, 16) is formed into a tube (20) and the side edges (14, 16) are welded or glued parallel to the tube longitudinal axis (x), the tube (20) is divided into tube sections (24) of equal length with cut edges (26, 28) lying in parallel planes, and the tube sections (24) are molded into lid rings (30), where a first cut edge (26) is formed into an outer rim (32) for connection with the can body and a second cut edge (28) is curled, the second cut edge (28) is curled away from side (56) of the lid ring (30) intended for the heat-sealable coating (40), and the heat-sealable coating (40) is sprayed onto the side (56) of the finished molded lid ring (30) intended to be outside of the finished molded lid ring (30).

12. A process for production of a lid ring (30), that can be connected to a can body, and that borders a discharge opening (38) and has a heat-sealable coating (40), on which to form a can lid (50) a closing membrane (44) can be heat-sealed covering the discharge opening (38), in which process a metal strip (12) with parallel side edges (14, 16) is formed into a tube (20) and the side edges (14, 16) are welded or glued parallel to the tube longitudinal axis (x), the tube (20) is divided into tube sections (24) of equal length with cut edges (26, 28) lying in parallel planes, and the tube sections (24) are molded into lid rings (30), where a first cut edge (26) is formed into an outer rim (32) for connection with the can body and a second cut edge (28) is curled, the second cut edge (28) is curled away from a side (56) of the lid ring (30) intended for the heat-sealable coating (40), and the heat-sealable coating (40) is applied as a powder coating to the side (56) of the finished molded lid ring (30) intended to be outside of the finished molded lid ring (30).

13. The process according to claim 12, wherein the lid ring (30) is coated with a heat-resistant lacquer (42) on it side facing away from the heat-sealable coating (40).

14. The process according to claim 13, wherein the heat-resistant lacquer (42) is sprayed onto the lid ring (30).

15. A process for production of a lid ring (30), that can be connected to a can body, and that borders a discharge opening (38) and has a heat-sealable coating (40), on which to form a can lid (50) a closing membrane (44) can be heat-sealed covering the discharge opening (38), in which process the metal strip (12), comprised of aluminum, steel or tin plate, with parallel side edges (14, 16) is formed into a tube (20) and the side edges (14, 16) are welded or glued parallel to the tube longitudinal axis (x), the tube (20) is divided into tube sections (24) of equal length with cut edges (26, 28) lying in parallel planes, and the tube sections (24) are molded into lid rings (30), where a first cut edge (26) is formed into an outer rim (32) for connection with the can body and the second cut edge (28) is curled, the second cut edge (28) is curled away from a side (56) of the lid ring (30) intended for the heat-sealable coating (40), and the heat-sealable coating (40) is sprayed onto the side (56) of the finished molded lid ring (30) intended to be outside of the finished molded lid ring (30).

16. A process for production of a lid ring (30), that can be connected to a can body, and that borders a discharge opening (38) and has a heat-sealable coating (40), on which to form a can lid (50) a closing membrane (44) can be heat-sealed covering the discharge opening (38), in which process the metal strip (12), comprised of aluminum, steel or tin plate, with parallel side edges (14, 16) is formed into a tube (20) and the parallel side edges (14, 16) of the metal strip (12) are pressed together in a butt joint into the tube (20) longitudinal axis (x) by means of laser beam (18), the tube (20) is divided into tube sections (24) of equal length with cut edges (26, 28) lying in parallel planes, and the tube sections (24) are molded into lid rings (30), where a first cut edge (26) is formed into an outer rim (32) for connection with the can body and the second cut edge (28) is curled, the second cut edge (28) is curled away from a side (56) of the lid ring (30) intended for the heat-sealable coating (40), and the heat-sealable coating (40) is sprayed onto the side (56) of the finished molded lid ring (30) intended to be outside of the finished molded lid ring (30).

17. A process for production of a lid ring (30), that can be connected to a can body, and that borders a discharge opening (38) and has a heat-sealable coating (40), on which to form a can lid (50) a closing membrane (44) can be heat-sealed covering the discharge opening (38), in which process the metal strip (12), comprised of aluminum, steel or tin plate, with parallel side edges (14, 16) is formed into a tube (20) and the side edges (14, 16) are welded or glued parallel to the tube longitudinal axis (x) the tube (20) is divided into tube sections (24) of equal length with cut edges (26, 28) lying in parallel planes, and the tube sections (24) are molded into lid rings (30), where a first cut edge (26) is formed into an outer rim (32) for connection with the can body and the second cut edge (28) is curled, the second cut edge (28) is curled away from a side (56) of the lid ring (30) intended for the heat-sealable coating (40), and the heat-sealable coating (40) is applied as a powder coating to the side (56) of the finished molded lid ring (30) intended to be outside of the finished molded lid ring (30).

18. A process for production of a lid ring (30), that can be connected to a can body, and that borders a discharge opening (38) and has a heat-sealable coating (40), on which to form a can lid (50) a closing membrane (44) can be heat-sealed covering the discharge opening (38), in which process the metal strip (12), comprised of aluminum, steel or tin plate, with parallel side edges (14, 16) is formed into a tube (20) and the parallel side edges (14, 16) of the metal strip (12) are pressed together in a butt joint into the tube (20) longitudinal axis (x) by means of laser beam (18), the tube (20) is divided into tube sections (24) of equal length with cut edges (26, 28) lying in parallel planes, and the tube sections (24) are molded into lid rings (30), where a first cut edge (26) is formed into an outer rim (32) for connection with the can body and the second cut edge (28) is curled, the second cut edge (28) is curled away from a side (56) of the lid ring (30) intended for the heat-sealable coating (40), and the heat-sealable coating (40) is applied as a powder coating to the side (56) of the finished molded lid ring (30) intended to be outside of the finished molded lid ring (30).

* * * * *